US007185476B1

(12) United States Patent
Siegel et al.

(10) Patent No.: US 7,185,476 B1
(45) Date of Patent: Mar. 6, 2007

(54) AUTOMATED SOLID PHARMACEUTICAL PRODUCT PACKAGING MACHINE

(75) Inventors: Todd Siegel, Clearwater, FL (US); Stuart Bagley, Clearwater, FL (US); Michael Stevenson, Clearwater, FL (US)

(73) Assignee: MTS, Medication Technologies, Inc., St. Petersburg, FL (US)

( * ) Notice: Subject to any disclaimer, the term of this patent is extended or adjusted under 35 U.S.C. 154(b) by 0 days.

(21) Appl. No.: 09/539,834

(22) Filed: Mar. 31, 2000

Related U.S. Application Data

(60) Provisional application No. 60/133,647, filed on May 11, 1999.

(51) Int. Cl.
*B65B 21/06* (2006.01)

(52) U.S. Cl. ..... 53/443; 53/450; 53/151; 53/154

(58) Field of Classification Search ..... 53/443, 53/450, 452, 471, 476, 133.2, 151, 153, 154, 53/155, 156, 560, 237, 238, 240, 287
See application file for complete search history.

(56) References Cited

U.S. PATENT DOCUMENTS

| | | | | | |
|---|---|---|---|---|---|
| 1,258,012 | A | | 3/1918 | Jedel | |
| 1,993,619 | A | | 3/1935 | Neff et al. | |
| 3,456,424 | A | | 7/1969 | Thurston et al. | |
| 3,780,856 | A | * | 12/1973 | Braverman | 206/42 |
| 4,233,799 | A | * | 11/1980 | Caille | 53/154 |
| 4,416,375 | A | * | 11/1983 | Braverman et al. | 206/534.1 |
| 4,490,963 | A | * | 1/1985 | Knudsen | 53/559 |
| 4,546,901 | A | * | 10/1985 | Buttarazzi | 221/10 |
| 4,655,026 | A | | 4/1987 | Wigoda | |
| 4,664,289 | A | | 5/1987 | Shimizu et al. | 221/2 |
| 4,733,362 | A | * | 3/1988 | Haraguchi | 206/534 |
| 4,834,264 | A | | 5/1989 | Siegel et al. | 221/200 |
| 4,844,246 | A | * | 7/1989 | Harrison et al. | 206/223 |
| 4,870,799 | A | | 10/1989 | Bergerioux et al. | |

(Continued)

FOREIGN PATENT DOCUMENTS

DE 3541672 A1 5/1987

OTHER PUBLICATIONS

Tosho Inc.; Sales Brochure for "Automatic Tablet Packing Machine BMP/CE"; Jun. 1, 1998; Japan.

(Continued)

*Primary Examiner*—Sameh H. Tawfik
(74) *Attorney, Agent, or Firm*—Robert J. Depke; Rockey, Depke, Lyons & Kitzinger, LLC

(57) ABSTRACT

A fully automated pharmaceutical product packaging machine is capable of selectively depositing one or more different solid pharmaceutical products into an individual cavity for each of a plurality of individual patient product package cavities. The system employs a plurality of solid pharmaceutical product dispensing canisters which are capable of selectively dispensing a pre-designated number of solid pharmaceutical products. The machine fills a template containing temporary storage cavities and the template is automatically positioned over a sheet of clear plastic material containing a plurality of cavities corresponding to the cavities in the template. A barrier between the cavities in the template and the sheet of clear plastic material is moved and the pharmaceuticals in the template cavities drop into the corresponding cavities in the clear plastic sheet of material. The clear plastic sheet of material is then maneuvered into subsequent product packaging stations and the template is returned to beneath the canister region.

8 Claims, 7 Drawing Sheets

U.S. PATENT DOCUMENTS 5,019,125 A * 5/1991 Rebne et al. ..... 206/532
5,348,061 A * 9/1994 Riley et al. ..... 141/104
5,358,118 A * 10/1994 Thompson et al. ..... 206/538
5,481,855 A 1/1996 Yuyama
5,522,512 A * 6/1996 Archer et al.
5,548,941 A 8/1996 Portaro et al.
5,658,802 A 8/1997 Hayes et al.
5,720,154 A 2/1998 Lasher et al.
5,753,456 A * 5/1998 Naqui et al. ..... 53/443
5,765,606 A 6/1998 Takemasa et al.
5,839,257 A * 11/1998 Soderstrom et al. ..... 53/411
5,852,911 A * 12/1998 Yuyama et al. ..... 53/168
6,023,916 A * 2/2000 Bouthiette ..... 53/471
6,170,230 B1 1/2001 Chudy et al.
6,318,051 B1 11/2001 Preiss
6,325,114 B1 12/2001 Bevirt et al.
6,334,980 B1 1/2002 Hayes et al.
6,508,279 B2 * 1/2003 Siegel et al.

OTHER PUBLICATIONS

Medical Packaging Inc.; Sales brochure for "AutoPak BPM"; USA.

* cited by examiner

AUTOMATED SOLID PHARMACEUTICAL PRODUCT PACKAGING MACHINE

This is a Continuation-In-Part of Application No. 60/133,647, Filed May 11, 1999, Titled: MULTI-MEDICATION BLISTER PACK FILLING MACHINE.

BACKGROUND OF THE INVENTION

1. Field of the Invention

The present invention relates generally to the field of automated pharmaceutical packaging machines. More specifically, the present invention is directed to an automated pharmaceutical packaging machine which simultaneously fills a product package template with desired solid pharmaceutical dosing requirements while also simultaneously sealing a final package containing a plurality of individual patient doses.

2. Description of the Related Art

There currently are a wide variety of automated pharmaceutical packaging machines available. The majority of these machines are designed for packaging a single pharmaceutical product into pharmaceutical package material. These machines typically transfer individual doses of solid pharmaceutical products into a cavity formed within a clear plastic cover member. Usually a plurality of cavities are formed in a single sheet of clear plastic material and a corresponding plurality of pharmaceutical products are inserted by the filling machine. Once the solid pharmaceutical members have been inserted into the cavities, a backing material is then adhesively applied to the clear plastic sheet to seal the solid pharmaceutical products within the cavities.

These automated machines satisfy the majority of solid pharmaceutical packaging requirements where a single product is inserted into a package. However, especially in managed care facilities, there is a significant need for an automated pharmaceutical packaging machine which is capable of selectively depositing one or more pharmaceuticals into each of the individual cavities in a pharmaceutical product package.

Managed care facilities now use patient specific packaging that provide all of a patient's prescription drug needs for a given period of time. Existing packaging solutions typically employ solid pharmaceutical product package cards that contain all the given patients' dosages for a one week period of time. Each dose of one or more pharmaceuticals is stored in a clear plastic cavity. These dosing cards usually include three to four different clear plastic cavities for any given day that correspond with each prescribed dosage time for a patient's medication requirements. Currently there are no automated systems for selectively filling a plurality of different dosing cavities with a plurality of different solid pharmaceutical medications for a single patient and which are also capable of simultaneously sealing the package cavities.

As a result, it is necessary that the managed care facility go through a more time consuming process in order to create a package containing a patient's dose of solid pharmaceuticals for a given period of time. Accordingly, there remains a need in the art for an automated pharmaceutical packaging machine which is capable of automatically selecting and depositing one or more solid pharmaceutical products into a plurality of medication packages for a patient while also simultaneously sealing and further processing a solid pharmaceutical product package.

SUMMARY OF THE INVENTION

The present invention overcomes the shortcomings of the prior art and provides a fully automated pharmaceutical product packaging machine which is capable of selectively depositing one or more different solid pharmaceutical products into an individual cavity for each of a plurality of individual patient product package cavities. The system that is descried below is a fully automated machine which is computer controlled and employs a plurality of solid pharmaceutical product dispensing canisters. Each of these solid pharmaceutical dispensing canisters is capable of selectively dispensing a pre-designated number of solid pharmaceutical products. The canisters are programmable and can be manipulated with a computer controller. These canisters are capable of selecting individual pills regardless of their size or shape and are commercially available.

The system of the present invention employs an array of canisters arranged within a mechanical feeding mechanism. Each canister is designed to feed a funnel or trough which transmits a solid pharmaceutical product selectively dispensed from one of the canisters into a cavity of a product package template. A plurality of pharmaceuticals may be selected for a single cavity member. This step is repeated for each of the plurality of cavities in template that corresponds with the cavities in a single sheet or card of cavities that provide a patient's dosing requirements for a given period of time.

For example, a single sheet may typically include all of the solid pharmaceutical products that have been prescribed for a patient during a one week period. The patient's doctor may have prescribed three or four different administration times during the week and accordingly the dosing card has typically between 21 and 28 different individual cavities. Each of the cavities are capable of holding a volume of solid pharmaceuticals necessary for patient dosing requirements. Once the template containing temporary storage cavities for each combination of drugs has been filled, the template is automatically positioned over a sheet of clear plastic material containing a plurality of cavities corresponding to the cavities in the template. A barrier between the cavities in the template and the sheet of clear plastic material is shifted or moved and the pharmaceuticals in the template cavities drop into the corresponding cavities in the clear plastic sheet of material. The clear plastic sheet of material is then maneuvered into subsequent product packaging stations and the template is returned to beneath the canister region. The template member is selectively moveable through a range of motion defined by an X-Y axis so that each cavity of the template may be selectively positioned beneath the feed mechanism for transfer of pharmaceuticals located in the canisters.

The system then simultaneously fills the template with either the dosing requirements for the same patient for another week or the dosing requirements for another patient for a given period of time. While the template is being filled, the sheet of clear plastic material now containing each of the solid pharmaceutical doses for the first patient are then simultaneously enclosed and packaged into a final package that may be given to a patient or the care givers for the patient so that the prescribed pharmaceuticals may be administered from the product package. Advantageously, the machine saves a significant amount of time by simultaneously filling the template while also packaging the previously selected pharmaceuticals. The present invention employs canisters which are commercially available for selectively for dispensing the desired quantity of solid pharmaceutical products. In order to complete the packaging process, a sheet of backing material is secured to the clear plastic members to enclose the pharmaceutical products within the clear plastic cavities as is known in the art. The machine of the present invention makes use of pneumatically controlled automated machinery for packaging and manipulating the product. Additionally, the system of the present invention includes pharmaceutical product package and sealing stations.

DETAILED DESCRIPTION OF THE PREFERRED EMBODIMENTS

Figure 1:
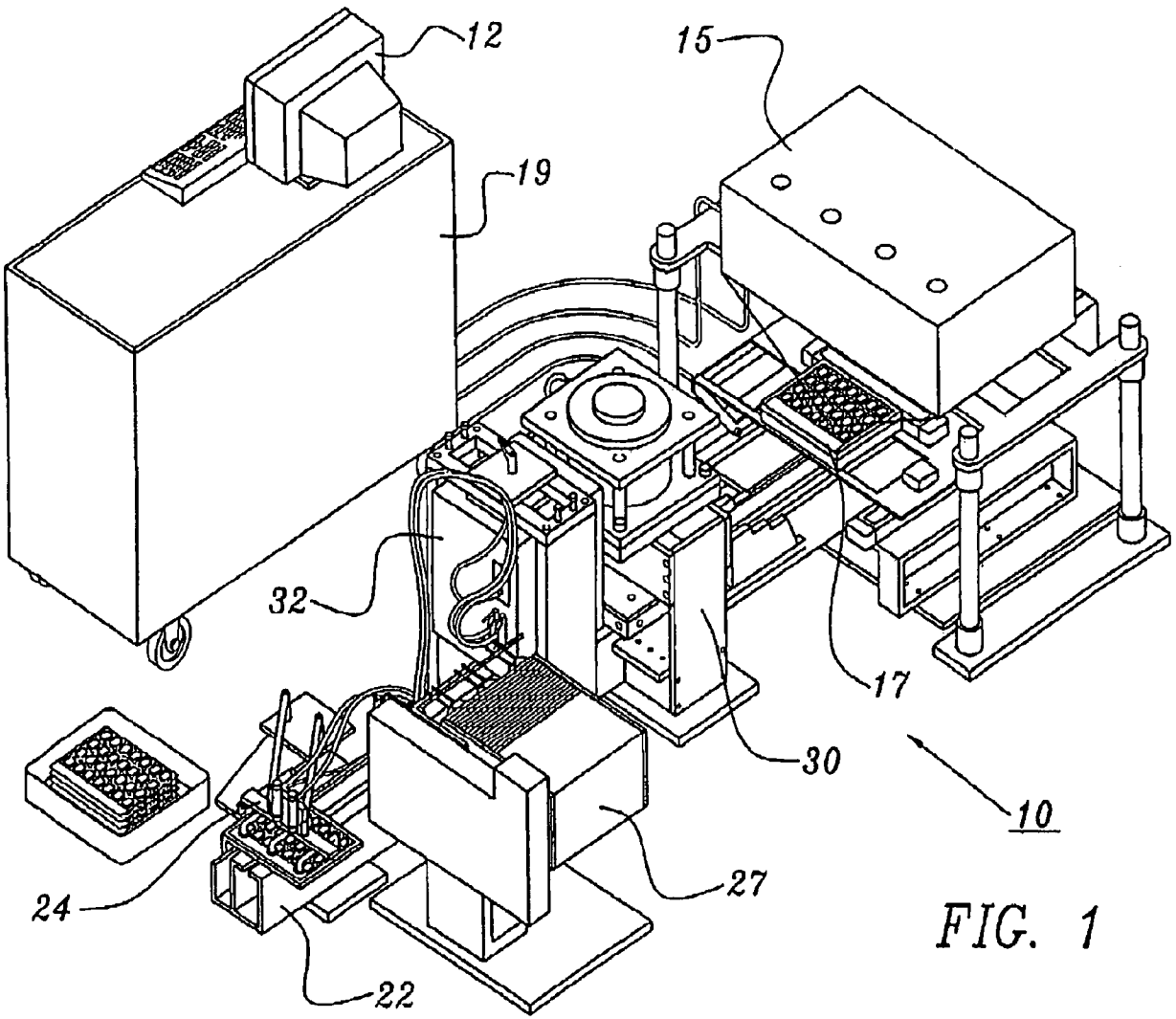
FIG. 1 illustrates a first embodiment of the present invention.

An embodiment of a fully automated pharmaceutical product packaging machine which is capable of selectively depositing one or more different solid pharmaceutical products into an individual cavity for each of a plurality of individual patient product package cavities is shown generally at 10 in FIG. 1. A computer 12 is linked with the various members of the system to control their respective operations. The system employs a plurality of solid pharmaceutical product dispensing canisters each of which are mounted in a pharmaceutical dispensing mechanism 15. The pharmaceutical dispensing canisters are commercially available products. Each of the solid pharmaceutical dispensing canisters located within the pharmaceutical dispensing mechanism 15 is capable of selectively dispensing a pre-designated number of solid pharmaceutical products. The canisters are each independently programmable and can be manipulated via the computer controller 12. The canisters are capable of selecting individual pills regardless of their size or shape.

Each canister is arranged within the pharmaceutical dispensing mechanism to feed a funnel or trough which transmits a solid pharmaceutical product selectively dispensed from one or more of the canisters into a cavity of a product package template 17. This step is repeated for each of the plurality of cavities in the template 17 that corresponds with the cavities in a single sheet or card of cavities in a package that provide a patient's dosing requirements for a given period of time. The template member 17 is selectively moveable through a range of motion defined by an X-Y axis so that each cavity of the template 17 may be selectively positioned beneath the feed mechanism of the pharmaceutical dispensing mechanism 15 for transfer of pharmaceuticals located in the canisters located therein. The dispensing mechanism 15 has a plurality of canisters that are controlled by signals from the computer. Each of the canisters may have a separate address so that the canisters will only respond to commands intended for the selected canister.

FIG. 1 also illustrates a cart 19 for convenient location of the computer controller 12. The moveable cart 19 may also provide a location for a pneumatic drive generator that is used in driving the stations of the machine. A package transfer track is shown at 22 and provides a mechanism for transferring a pharmaceutical product package 23 between each of the separate stations of the machine. A lift mechanism 24 lifts and transfers filled pharmaceutical product packages 23 from the transfer track 22.

A product package dispensing unit is shown at 27 and transfers empty package members onto the transfer track 22. Those skilled in the art will appreciate that one or more product package dispensing members may be used for transferring portions of packages to the filling machine. The system of the present invention also includes a product package sealing station 30 and a printing station 32. The product package dispensing unit 27 is shown adjacent the printing station 32, however, it is preferred that each package dispensing station be located adjacent or near the pharmaceutical product dispensing unit 15. This eliminates travel of the product package during the manufacturing process and also enables the filling of the pharmaceutical package template to take place simultaneously with sealing and/or further processing of another package member.

Each of the cavities of a pharmaceutical product package are capable of holding a volume of solid pharmaceuticals necessary for patient dosing requirements. Once the template 17 containing temporary storage cavities for each combination of drugs has been filled, the template is automatically positioned over a portion of a pharmaceutical product package comprising a sheet of clear plastic material containing a plurality of cavities. The cavities in the clear plastic material correspond to the cavities in the template. A barrier between the cavities in the template 17 and the sheet of clear plastic material is moved when the desired number of cavities have been filled and the pharmaceuticals in the template cavities drop into the corresponding cavities in the clear plastic sheet of material.

The clear plastic sheet of material is then maneuvered adjacent to at least one package sealing member and the combined structure of the now filled plastic sheet and the sealing member is then transferred along transfer track 22 to the product package sealing station 30. While this occurs, the template 17 is returned to beneath the pharmaceutical dispensing mechanism 15.

The system 10 then simultaneously fills the template with either the dosing requirements for the same patient for another week or the dosing requirements for another patient for a given period of time. While the template 17 is being filled, the sheet of clear plastic material now containing each of the solid pharmaceutical doses for the first patient are then simultaneously enclosed and sealed by the sealing station 30 into a final package that may be given to a patient or the care givers for the patient so that the prescribed pharmaceuticals may be administered from the product package. A sheet of backing material is secured to the clear plastic members to enclose the pharmaceutical products within the clear plastic cavities as is known in the art.

Advantageously, the machine saves a significant amount of time by simultaneously filling the template while also packaging the previously selected pharmaceuticals. The machine of the present invention desirably makes use of pneumatically controlled automated machinery for packag ing and manipulating the product, however, those skilled in the art will appreciate that the machine of the present invention may be powered by any conventional or future developed drive mechanism. For example stepping motors may be used for mechanical manipulation of various elements as described above.

Figure 2:
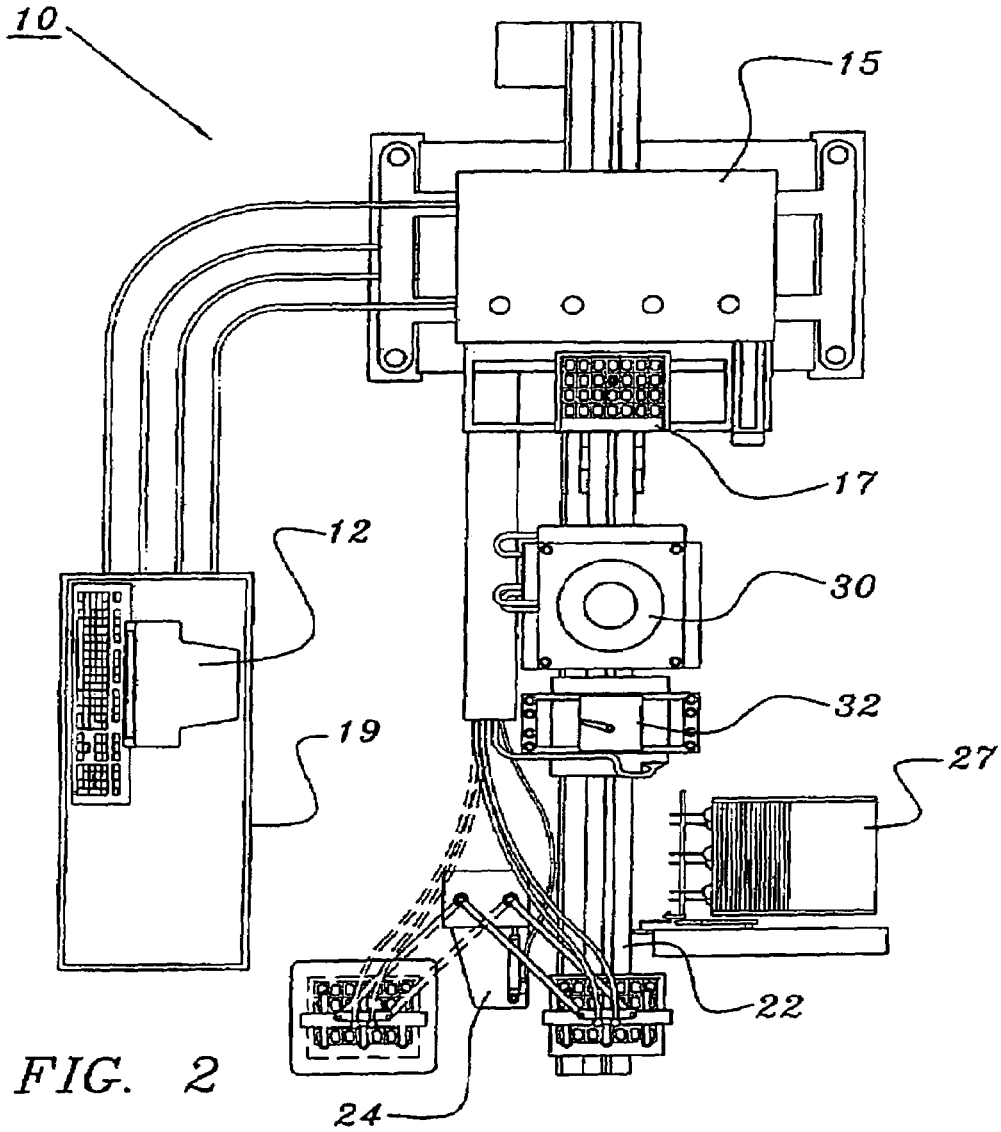
FIG. 2 illustrates a top plan view of the embodiment of the device set forth in FIG. 1.

FIG. 2 illustrates a top plan view of the system described above with reference to FIG. 1. FIG. 2 illustrates the relative spacing of the various manufacturing stations described above. As noted, it is actually preferred that the empty product package dispensing station 27 actually be located adjacent the pharmaceutical dispensing station 15. Additionally, those skilled in the art will appreciate that additional product package dispensing stations may be inserted between the sealing station 30 and the pharmaceutical dispensing mechanism depending on the number of distinct package elements that to be sealed together by the sealing station 30.

Figure 3:
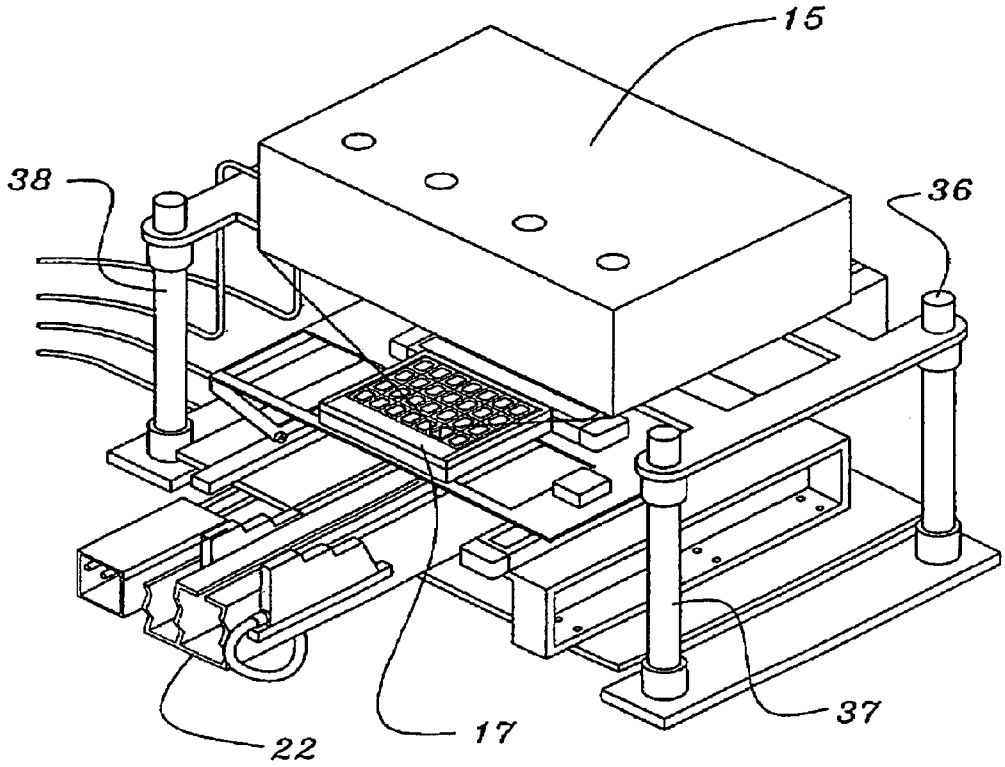
FIG. 3 illustrates an automated canister delivery mechanism.
Figure 4:
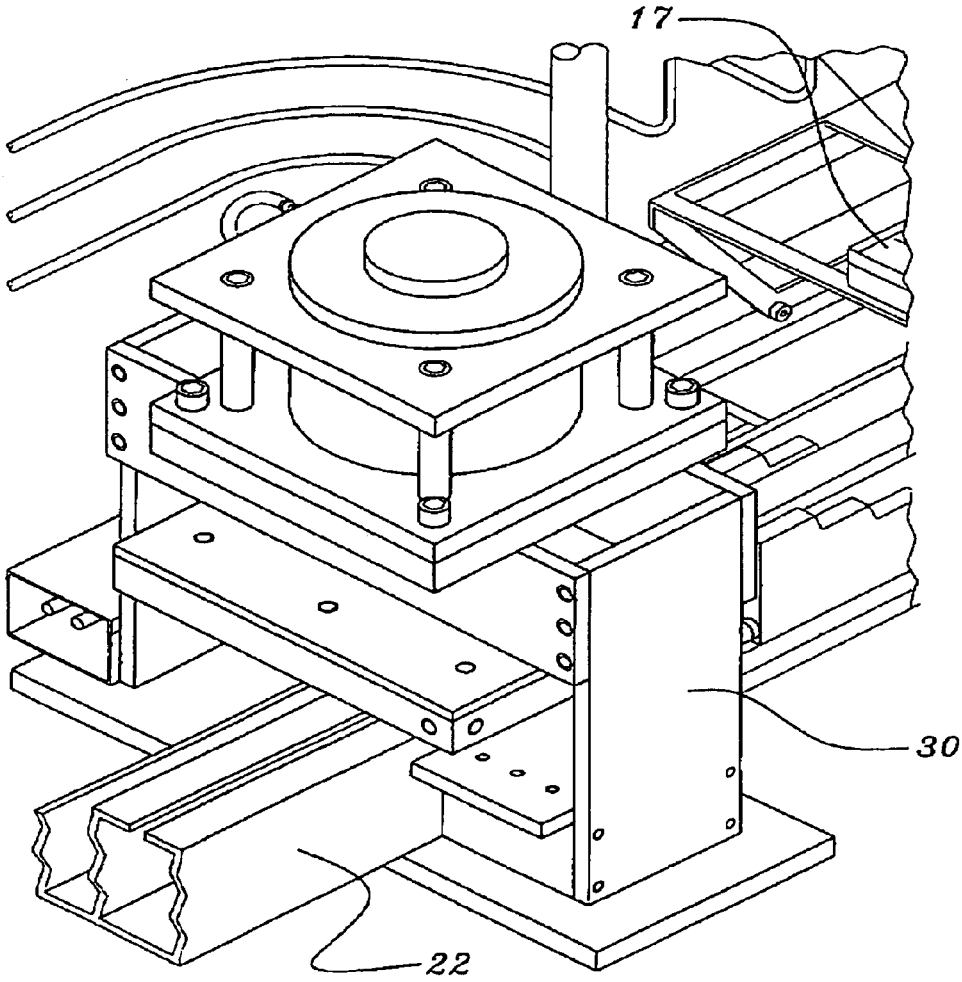
FIG. 4 illustrates a machine that is used in transferring solid pharmaceuticals from a template into a sheet of clear plastic material having cavities for receiving solid pharmaceutical products.

FIG. 3 illustrates the pharmaceutical product dispensing unit 15 as well as the template member 17. As shown in FIG. 3, the pharmaceutical product dispensing unit 15 is supported by structural support members 36, 37, and 38. Control lines 42 connect the canisters with the computer 12 so that the desired pharmaceuticals may be dispensed by the machine. FIG. 4 is a detailed view of the package sealing station 30. As shown in FIG. 4, the product package transfer track 22 passes directly beneath the sealing station 30. The sealing station 30 may be comprised of any conventional sealing mechanism. For example, this sealing station 30 may be capable of applying heat or pressure or some type of electromagnetic radiation or combinations of these sealing techniques in order to set any adhesives that has been previously applied to the product packaging material. One significant feature is that the relationship of these structures allows for simultaneously filling the product template while also sealing another filled package or otherwise further processing the package.

Figure 5:
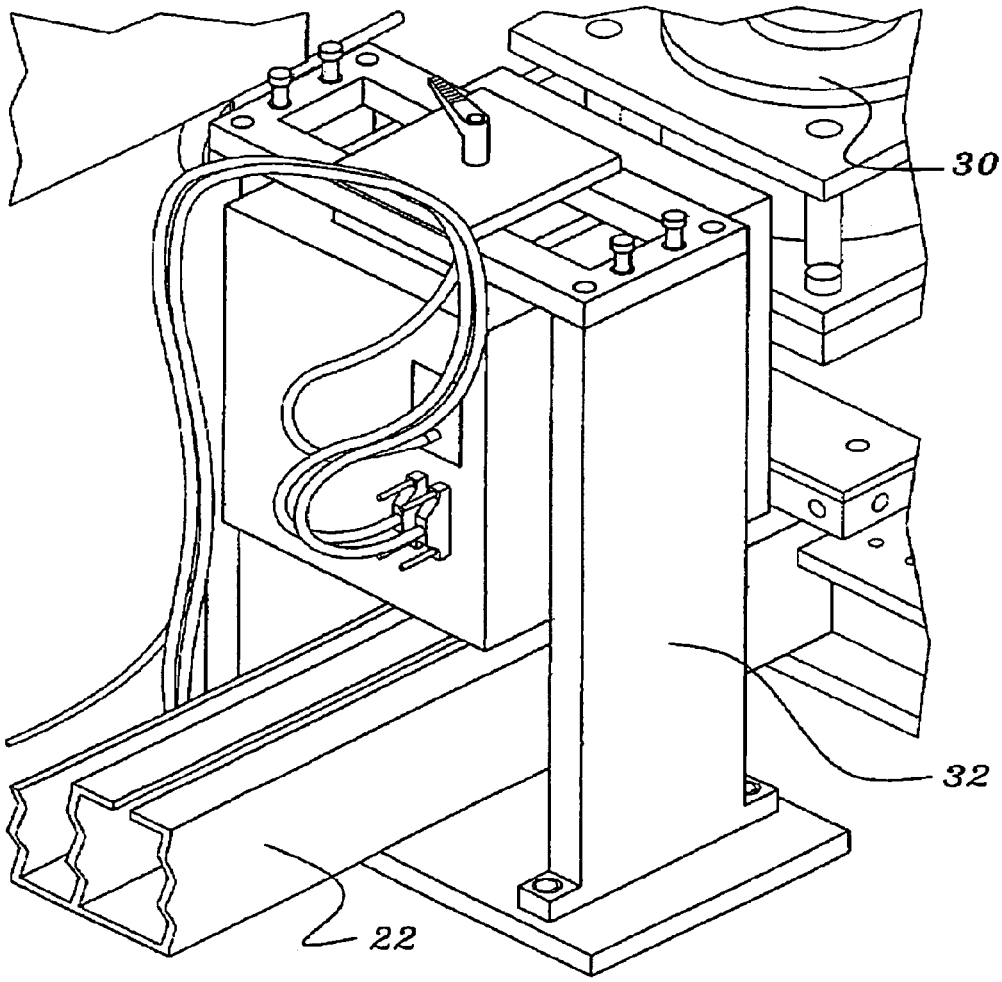
FIG. 5 illustrates a machine for selectively sealing backing member onto a clear plastic sheet.

FIG. 5 illustrates a conventional printing station that is mounted above the pharmaceutical product package transfer track 22. This station prints information on the sealed product package which may relate to such things as identification of the patient, the time and dates for which the medication has been prescribed as well content information and/or expiration information. Significantly, this station is also capable of operating in parallel and independent from the pharmaceutical dispensing station 15.

Figure 6:
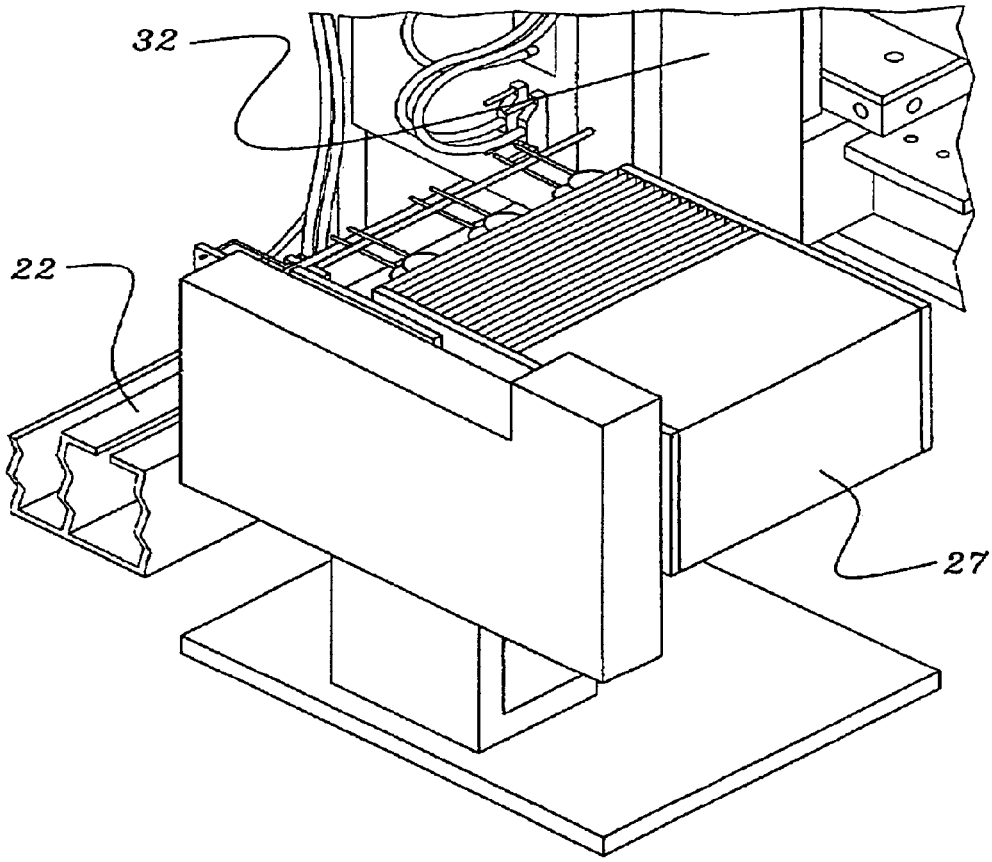
FIG. 6 illustrates a machine that is used in dispensing the backing material for the cards.

FIG. 6 illustrates the pharmaceutical product package dispensing station 27. This station is also typical of known automated product package dispensing devices. The station is desirably mounted adjacent the product package transfer track 22 so that product packages or partial packages may be readily placed on the track member 22. As noted it is preferred that one or more of these stations be located between the sealing station 30 and the dispensing station 15.

Figure 7:
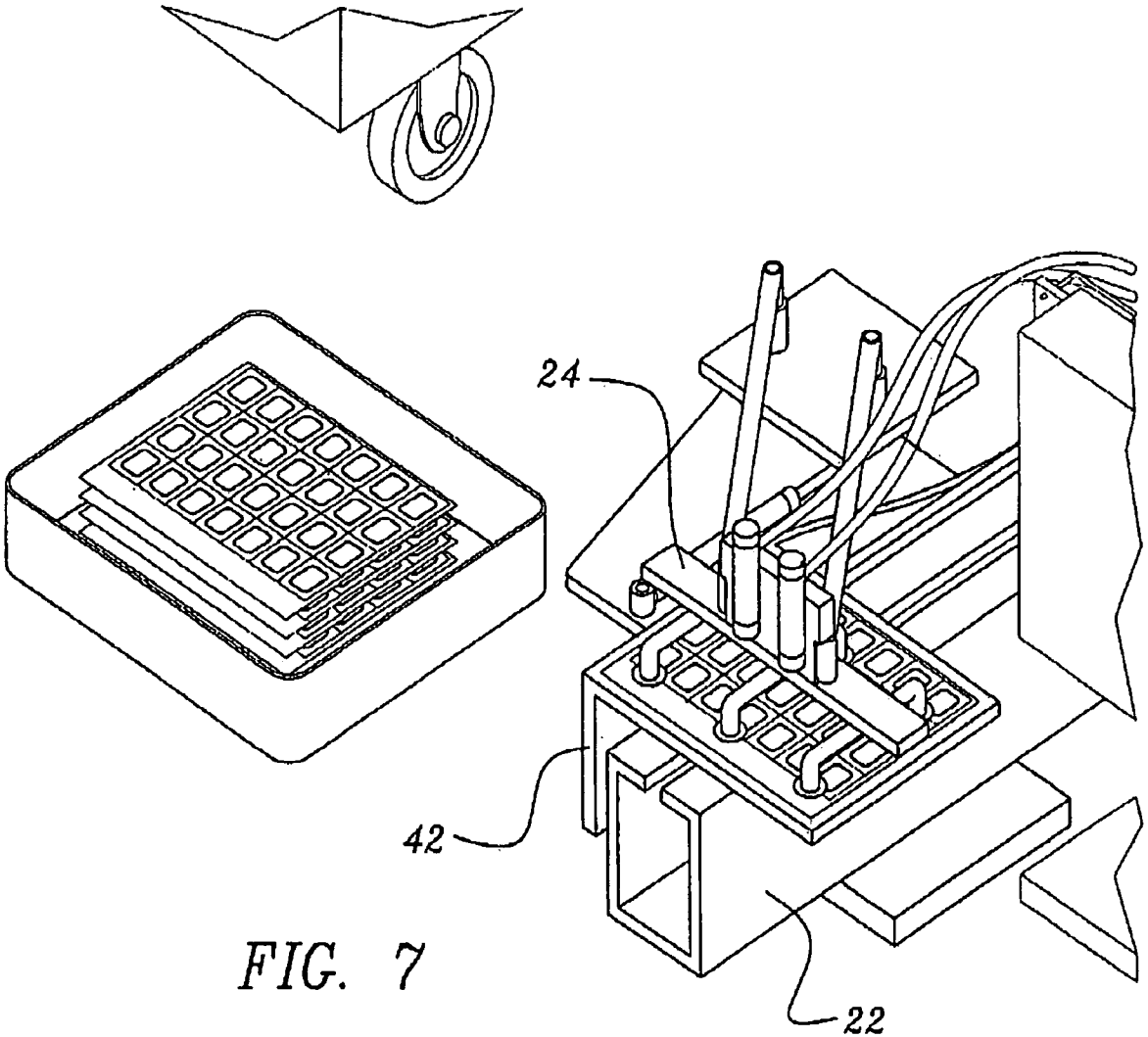
FIG. 7 illustrates a machine that is used for lifting the finished product from the assembly line.

FIG. 7 illustrates an automated device 24 which automatically removes the completed product packages from the transfer track 22. FIG. 7 also illustrates a completed package located on the transfer mechanism 42 which is mounted in the product package transfer track 22.

We claim:

1. A method of filling solid pharmaceutical product packaging comprising the steps of:

providing a product package template having a plurality of cavities arranged in an array having rows and columns;

providing a product package having a plurality of cavities, wherein said cavities of said product package are capable of alignment with said cavities of said product package template;

automatically selectively dispensing one or more solid pharmaceutical products from a plurality of different drug sources into a common funnel automatically effecting relative motion in at least two directions of motion between the common funnel and said plurality of product package template cavities to selectively locate the common funnel over individual ones of the cavities in order to place one or more solid pharmaceutical products from the plurality of different drug sources into each of said plurality of template cavities, wherein the two directions of motion are generally perpendicular; and thereafter automatically aligning said cavities of said product package template with said cavities of said product package; and transferring the solid pharmaceuticals located in the plurality of product package template cavities into corresponding cavities of said product package.

2. The method of claim 1, further comprising a step of, during said step of selectively dispensing the solid pharmaceutical products, simultaneously sealing another pharmaceutical product package that has been previously filled with a variety of solid pharmaceuticals.

3. The method of claim 2, further comprising a step of printing information on a pharmaceutical product package.

4. The method of claim 2, further comprising a step of at least substantially simultaneously dispensing first and second pharmaceuticals from first and second canisters into a single template cavity.

5. The method of claim 1, further comprising a step of printing information on a pharmaceutical product package.

6. The method of claim 1, further comprising a step of at least substantially simultaneously dispensing first and second pharmaceuticals from first and second canisters into a single template cavity.

7. The method of claim 1, wherein the step of effecting relative motion comprises moving the product package template cavities beneath the funnel such that each of the desired template cavities is placed beneath the funnel.

8. The method of claim 1, further wherein the two directions of motion are in a common plane beneath the common funnel and the common funnel providing a single transmission path being incrementally moved so that it is selectively located at a location corresponding to each of the individual cavities of the template to thereby fill each of the template cavities in a two-dimensional array with one or more solid pharmaceutical products.

* * * * *